US006939999B2

(12) United States Patent
Abazajian et al.

(10) Patent No.: US 6,939,999 B2
(45) Date of Patent: Sep. 6, 2005

(54) INTEGRATED FISCHER-TROPSCH PROCESS WITH IMPROVED ALCOHOL PROCESSING CAPABILITY

(75) Inventors: Armen N. Abazajian, Houston, TX (US); H. Lynn Tomlinson, Tulsa, OK (US); Peter Z. Havlik, Tulsa, OK (US); Milton D. Clingan, Bartlesville, OK (US)

(73) Assignee: Syntroleum Corporation, Tulsa, OK (US)

( * ) Notice: Subject to any disclaimer, the term of this patent is extended or adjusted under 35 U.S.C. 154(b) by 196 days.

(21) Appl. No.: 10/426,154

(22) Filed: Apr. 29, 2003

(65) Prior Publication Data

US 2004/0167234 A1 Aug. 26, 2004

Related U.S. Application Data

(60) Provisional application No. 60/449,560, filed on Feb. 24, 2003.

(51) Int. Cl.[7] ..... C07C 41/00; C07C 27/00; C10G 47/00; C10G 35/00

(52) U.S. Cl. ..... 585/640; 518/700; 518/703; 518/704; 208/58; 208/133

(58) Field of Search ..... 518/700, 703, 518/704; 585/640; 208/58, 133

(56) References Cited

U.S. PATENT DOCUMENTS

| | | | |
|---|---|---|---|
| 3,852,207 | A | 12/1974 | Stangeland et al. |
| 3,904,513 | A | 9/1975 | Fischer et al. |
| 4,080,397 | A | 3/1978 | Derr et al. |
| 4,131,568 | A | 12/1978 | Bartish |
| 4,157,294 | A | 6/1979 | Iwao et al. |
| 4,207,424 | A | 6/1980 | Winnick |
| 4,423,274 | A | 12/1983 | Daviduk et al. |
| 4,497,968 | A | 2/1985 | Wright et al. |
| 4,513,160 | A | 4/1985 | Avidan et al. |
| 4,513,161 | A | 4/1985 | Mauldin |
| 4,542,122 | A | 9/1985 | Payne et al. |
| 4,547,601 | A | 10/1985 | Holland et al. |
| 4,556,752 | A | 12/1985 | Mauldin et al. |
| 4,568,663 | A | 2/1986 | Mauldin |
| 4,579,995 | A | 4/1986 | Mauldin |
| 4,628,135 | A | 12/1986 | Owen et al. |
| 4,640,764 | A | 2/1987 | Hamilton, Jr. |

(Continued)

FOREIGN PATENT DOCUMENTS

| | | |
|---|---|---|
| EP | 0 583 836 A1 | 2/1994 |
| EP | 1 101 813 | 5/2001 |
| WO | WO 01/46096 A1 | 6/2001 |
| WO | WO 03/066777 | 8/2003 |

OTHER PUBLICATIONS

Natarajan, G.S. et al. "Alumina Catalyst for Alcohol Dehydration", Indian Journal of Tech., 10 (1972): 463–464.

S.A. Ali, H.S. Mazhar et al. "Catalyst Conversion of Isopropanol on A12o3–Nd2o3 Supported on Silica," Afinidad 53 (1996) 61.

R.M. Cursetji, A.N. Singh an A.C. Deo "Ethylene from Ethyl Alcoho on High Silica Zeolite Catalyst," Chem. Age of India, vol. 37, No. 6, Jun. 1986, 407–410.

Jose Corella and Jose M. Asua "Kinetics and Mechanism of Deactivation by Fouling of a Silica–Alumina Catalyst.." The Canadian Journ. of Chem. Eng., vol. 59, Aug. 1981, 506–510.

*Primary Examiner*—J. Parsa
(74) *Attorney, Agent, or Firm*—Baker & McKenzie LLP; Valerie Friedrich

(57) ABSTRACT

An integrated Fischer-Tropsch process having improved alcohol processing capability is provided. The integrated Fischer-Tropsch process includes, optionally, synthesis gas production, Fischer-Tropsch reaction, Fischer-Tropsch reaction product recovery and, optionally, separation, catalytic dehydration of primary and internal alcohols, and, optionally, hydro-processing.

41 Claims, 4 Drawing Sheets

U.S. PATENT DOCUMENTS

| | | | | |
|---|---|---|---|---|
| 4,663,305 | A | | 5/1987 | Mauldin et al. |
| 4,670,475 | A | | 6/1987 | Mauldin |
| 4,751,345 | A | | 6/1988 | Mauldin |
| 4,755,536 | A | | 7/1988 | Mauldin et al. |
| 4,762,959 | A | | 8/1988 | Mauldin et al. |
| 4,795,730 | A | | 1/1989 | Drake |
| 4,832,819 | A | | 5/1989 | Hamner |
| 4,973,453 | A | | 11/1990 | Agee |
| 5,023,389 | A | | 6/1991 | Grandvallet et al. |
| 5,227,563 | A | | 7/1993 | Fukuhara et al. |
| 5,475,183 | A | | 12/1995 | Araki et al. |
| 5,733,941 | A | | 3/1998 | Waycuilis |
| 5,811,620 | A | | 9/1998 | Knifton et al. |
| 5,817,906 | A | | 10/1998 | Marker et al. |
| 5,861,441 | A | | 1/1999 | Waycuilis |
| 5,869,434 | A | | 2/1999 | Mueller et al. |
| 6,121,504 | A | | 9/2000 | Kuechler et al. |
| 6,130,259 | A | | 10/2000 | Waycuilis |
| 6,155,039 | A | * | 12/2000 | Agee et al. ..... 60/780 |
| 6,169,120 | B1 | | 1/2001 | Beer |
| 6,172,124 | B1 | | 1/2001 | Wolflick et al. |
| 6,344,491 | B1 | | 2/2002 | Beer et al. |
| 6,384,170 | B1 | | 5/2002 | Krull et al. |
| 2001/0021724 | A1 | | 9/2001 | Arcuri et al. |
| 2002/0003102 | A1 | | 1/2002 | O'Rear et al. |
| 2003/0166982 | A1 | * | 9/2003 | O'Rear et al. ..... 585/331 |

* cited by examiner

INTEGRATED FISCHER-TROPSCH PROCESS WITH IMPROVED ALCOHOL PROCESSING CAPABILITY

CROSS REFERENCE TO RELATED APPLICATIONS

This application claims priority to U.S. Provisional Application Ser. No. 60/449,560, filed on Feb. 24, 2003.

FEDERALLY SPONSORED RESEARCH

Not applicable.

REFERENCE TO MICROFICHE APPENDIX

Not applicable.

FIELD OF THE INVENTION

The present invention relates to an improved, integrated Fischer-Tropsch process with improved alcohol processing capabilities. More specifically, the invention relates to a Fischer-Tropsch process including dehydration of alcohols by passing all or a part of the Fischer-Tropsch product over alumina, followed by separation of the organic and aqueous phases.

BACKGROUND OF THE INVENTION

Having been first introduced in the early twentieth century, the Fischer-Tropsch reaction for catalytically converting carbon monoxide and hydrogen into hydrocarbons is very well known. Furthermore, numerous improvements to the process, including the development of more efficient and selective catalysts, have been made. All currently known Fischer-Tropsch processes, however, produce a synthetic crude, "syncrude," which contains primarily paraffins, and olefins with varying amounts of oxygenates. The oxygenates typically include primary and internal alcohols, the major portion, aldehydes, ketones and acids. The heavy portion of syncrude must be hydroprocessed into usable products. The presence of oxygenates presents certain problems with processing the syncrude, including a negative impact on hydroprocessing catalysts and necessitating an increase in the severity of hydroprocessing. The oxygenate content is generally higher in the lower boiling range distillation cuts of the Fischer-Tropsch product and declines precipitously at the 600° F. cut point. One method of avoiding the negative impact of the oxygenates on the hydroprocessing catalysts is to bypass the lower boiling range distillation cuts around the hydroprocessing unit. The lower boiling range distillation cuts, including any oxygenate content, are then used to reblend the lower boiling range cut with the hydrocracked higher boiling range distillation cut to form the product fuel. While a bypassed 250–400° F. distillation cut has no appreciable negative impact when re-blended into the product fuel, reincorporation of a bypassed 400° F.+ distillation cut impairs the low temperature properties of the product fuel. Therefore, it is common to hydroprocess the entire 400° F.+ fractions, including hydrogenation of oxygenates, which has significant impact on catalyst life and causes yield loss. Catalytic hydroprocessing catalysts of noble metals are well known, some of which are described in U.S. Pat. Nos. 3,852,207; 4,157,294; 3,904,513. Hydroprocessing schemes utilizing non-noble metals, such as cobalt catalysts, promoted with rhenium, zirconium, hafnium, cerium or uranium, to form a mixture of paraffins and olefins have also been used. Such hydrotreatment, however, is expensive, utilizing high cost catalysts, which are degraded by the presence of alcohol thereby necessitating frequent replenishment.

There remains a need, therefore, for an improved integrated Fischer-Tropsch process in which the alcohol content of the oxygenates produced in the Fischer-Tropsch reaction may be wholly or partially removed at a lower cost and without a significant loss of yield.

SUMMARY OF THE INVENTION

In a Fischer-Tropsch process wherein a synthesis gas is catalytically converted into a Fischer-Tropsch reaction product mixture comprising paraffins and oxygenates and wherein the oxygenates include primary and internal alcohols, the process improvement of the invention includes passing all or part of the Fischer-Tropsch reaction product mixture over at least one bed packed with an alumina catalyst to dehydrate substantially all of the alcohols to their corresponding olefins.

DESCRIPTION OF EMBODIMENTS OF THE INVENTION

Figure 1:
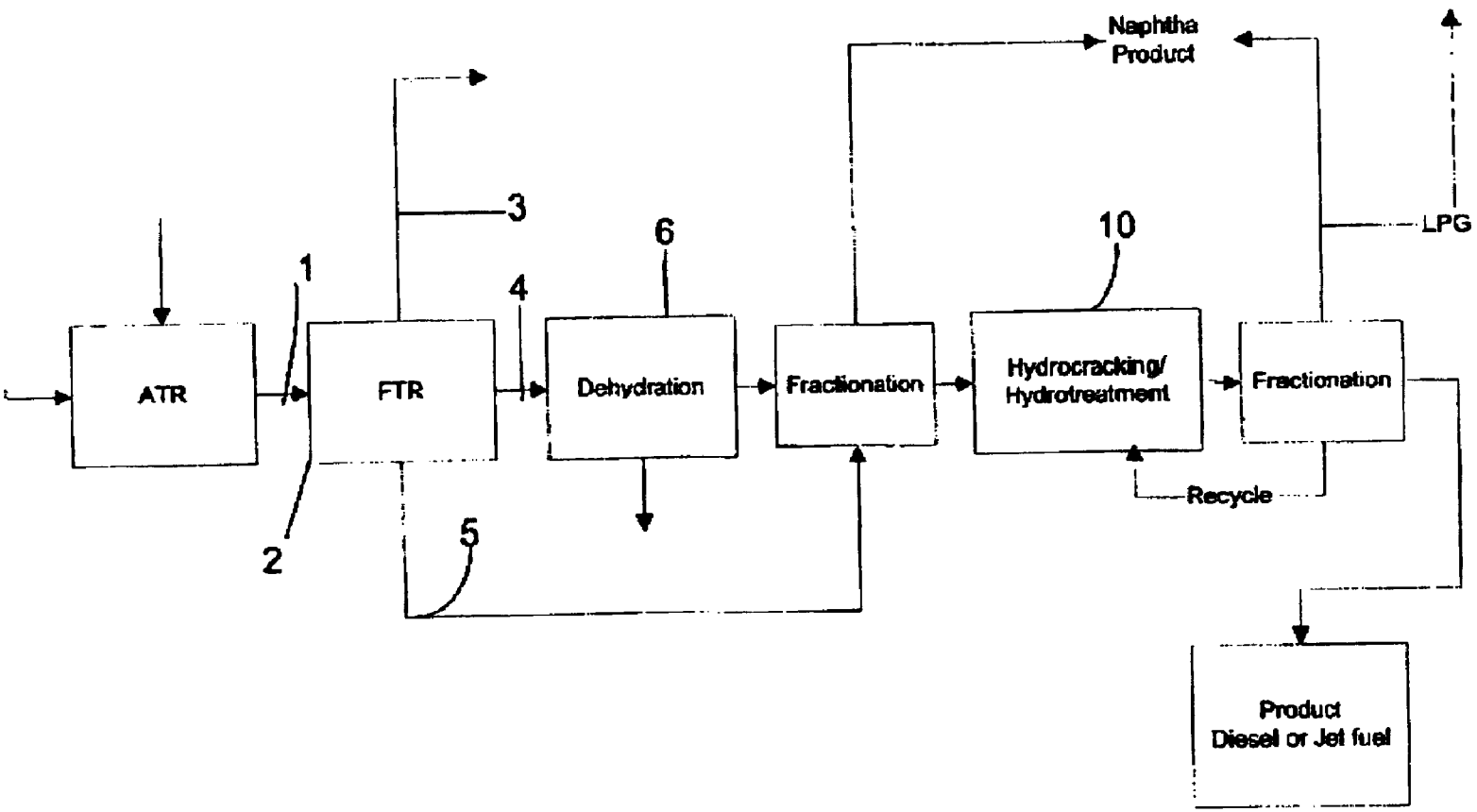
FIG. 1 is a schematic of an embodiment of the integrated Fischer-Tropsch Process.

The integrated Fischer-Tropsch process includes processing of synthesis gas to produce a hydrocarbon stream via the Fischer-Tropsch reaction, recovery of the Fischer-Tropsch product, catalytic dehydration of all or part of the Fischer-Tropsch product, and recovery of the hydrocarbons by phase separation. Optional steps in the integrated process include production of a synthesis gas, fractionation or distillation of the Fischer-Tropsch product prior to dehydration and hydroprocessing of part of the Fischer-Tropsch hydrocarbon product. A wide variety of Fischer-Tropsch reaction processes are known in which reaction conditions, catalysts, and reactor configurations vary. The integrated Fischer-Tropsch process of the invention may be used with any such reaction conditions, catalysts, and reactor configurations. For the purposes of the description below, one known Fischer-Tropsch synthesis is described. Other variations of Fischer-Tropsch synthesis are described, inter alia, in U.S. Pat. Nos. 4,973,453; 6,172,124; 6,169,120; and 6,130,259; the disclosures of which are all incorporated herein by reference.

Three basic techniques may be employed for producing a synthesis gas, or syngas, which is used as the starting material of a Fischer-Tropsch reaction. These include oxidation, reforming and autothermal reforming. As an example, a Fischer-Tropsch conversion system for converting hydrocarbon gases to liquid or solid hydrocarbon products using autothermal reforming includes a synthesis gas unit, which includes a synthesis gas reactor in the form of an autothermal reforming reactor (ATR) containing a reforming catalyst, such as a nickel-containing catalyst. A stream of light hydrocarbons to be converted, which may include natural gas, is introduced into the reactor along with oxygen ($O_2$). The oxygen may be provided from compressed air or other compressed oxygen-containing gas, or may be a pure oxygen stream. The ATR reaction may be adiabatic, with no heat being added or removed from the reactor other than from the feeds and the heat of reaction. The reaction is carried out under sub-stoichiometric conditions whereby the oxygen/steam/gas mixture is converted to syngas.

The Fischer-Tropsch reaction for converting syngas, which is composed primarily of carbon monoxide (CO) and hydrogen gas ($H_2$), may be characterized by the following general reaction:

$$2nH_2+nCO\rightarrow(\text{—}CH_2\text{—})_n+nH_2O \quad (1)$$

Non-reactive components, such as nitrogen, may also be included or mixed with the syngas. This may occur in those instances where air, enriched air, or some other non-pure oxygen source is used during the syngas formation.

The syngas is delivered to a synthesis unit, which includes a Fischer-Tropsch reactor (FTR) containing a Fischer-Tropsch catalyst. Numerous Fischer-Tropsch catalysts may be used in carrying out the reaction. These include cobalt, iron, ruthenium as well as other Group VIIIB transition metals or combinations of such metals, to prepare both saturated and unsaturated hydrocarbons. The Fischer-Tropsch catalyst may include a support, such as a metal-oxide support, including silica, alumina, silica-alumina or titanium oxides. For example, a Co catalyst on transition alumina with a surface area of approximately 100–200 m2/g may be used in the form of spheres of 50–150 $\mu$m in diameter. The Co concentration on the support may also be 15–30%. Certain catalyst promoters and stabilizers may be used. The stabilizers include Group IIA or Group IIIB metals, while the promoters may include elements from Group VIII or Group VIIB. The Fischer-Tropsch catalyst and reaction conditions may be selected to be optimal for desired reaction products, such as for hydrocarbons of certain chain lengths or number of carbon atoms. Any of the following reactor configurations may be employed for Fischer-Tropsch synthesis: fixed bed, slurry bed reactor, ebullating bed, fluidizing bed, or continuously stirred tank reactor (CSTR). The FTR may be operated at a pressure of 100 to 500 psia and a temperature of 375° F. to 500° F. The reactor gas hourly space velocity ("GHSV") may be from 1000 to 8000 hr–1. Syngas useful in producing a Fischer-Tropsch product useful in the invention may contain gaseous hydrocarbons, hydrogen, carbon monoxide and nitrogen with $H_2$/CO ratios from about 1.8 to about 2.4. The hydrocarbon products derived from the Fischer-Tropsch reaction may range from methane ($CH_4$) to high molecular weight paraffinic waxes containing more than 100 carbon atoms.

Referring to FIG. 1, an overview of the integrated Fischer Tropsch process is illustrated. Synthesis gas contained in line 1 is fed to a Fischer-Tropsch reactor (FTR) 2. The tail gas of the Fischer-Tropsch product is recovered overhead in line 3 and the Fischer-Tropsch oil and wax are fractionated and recovered through lines 4 and 5. The product recovered in line 4 is a Light Fischer Tropsch Liquid (LFTL), and the product recovered in line 5 is a Heavy Fischer Tropsch Liquid (HFTL). Alternatively, LFTL and HFTL may be further fractionated into at least a nominally 30–550° F. distillate and 500° F.+ bottoms stream. LFTL and HFTL may also be fractionated into a number of other fractions as required by the desired product slate.

All or part of the LFTL, which is comprised primarily of $C_4$ to $C_{22}$ paraffins, is fed into the dehydration unit 6. In the integrated Fischer-Tropsch process, primary and internal alcohols present in the LFTL are dehydrated to yield corresponding olefins. Such conversions illustrated for the case of a primary alcohol by the following reaction:

$$R\text{—}CH_2\text{—}CH_2\text{—}OH\rightarrow R\text{—}CH{=}CH_2+H_2O \quad (2).$$

wherein R is an alkyl group and R—$CH_2$—$CH_2$—OH is an alcohol having a boiling point such that it is distilled as part of the LFTL.

Figure 2:
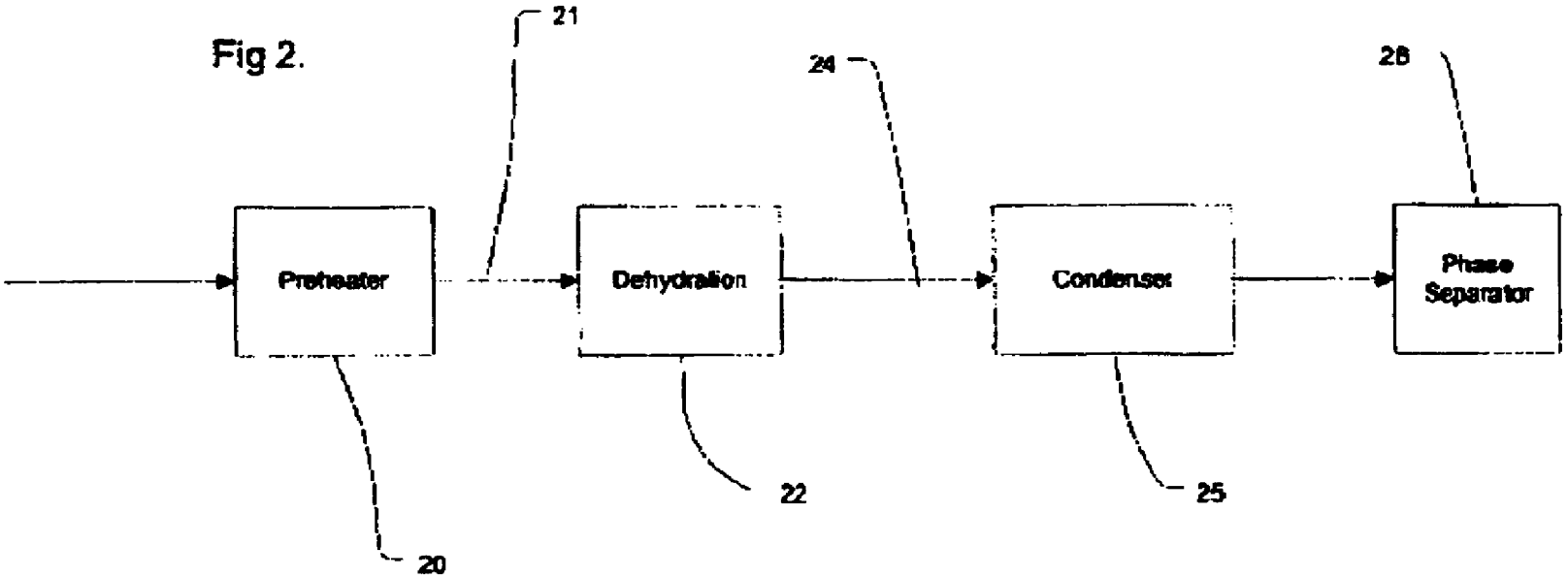
FIG. 2 is a schematic of the catalytic dehydration unit of the integrated Fischer-Tropsch process.

Referring now to FIG. 2, a schematic of the dehydration unit of the integrated Fischer Tropsch process is shown. The LFTL stream is vaporized in a preheater 20. The vaporized LFTL stream at a temperature from about 400° F. to about 800° F. is passed through line 21 into one or more packed beds 22 where it passes over activated treated alumina or silica-alumina. Essentially all of the primary and internal alcohols present in the vaporized LFTL are dehydrated to their corresponding olefins, with conversion rates of at least 95%.

Dehydration reaction temperature may range from between about 400° and 800° F. The vaporized feed for the dehydration unit may be superheated prior to being fed into packed beds 22 or alternatively, may be heated within packed beds 22. The LHSV of packed beds 22 may range from about 0.10 $hr^{-1}$ to about 2.0 $hr^{-1}$. Reaction pressure may be maintained by the pressure of the accumulator and must be such to vaporize all of the dehydration feed. Typically, the pressure may range from between about 0 psia to about 100 psig. The LFTL stream may be mixed with nitrogen gas or steam prior to or after preheater 20. The nitrogen gas or steam acts to help I vaporizing heavier components of the LFTL stream.

In an alternative embodiment, a moving bed of alumina or silica-alumina catalyst may be used. Coking is an undesirable side reaction in this synthesis. Fluidized beds, slurry beds or ebullating beds may be used with continuous batch or semi-batch catalyst removal and regeneration. The catalyst may be removed by one of these methods and regenerated by passing a mixture of nitrogen and oxygen or air at elevated temperatures over the catalyst.

Depending upon the alumina used, some of the olefins present or produced in packed beds 22 may also be isomerized to internal olefins. Alumina catalysts useful for the dehydration of alcohols are known and include, for example, gamma-alumina, theta-alumina, pacified alumina, and activated alumina. High surface area aluminas are particularly useful in the invention and include those aluminas having a surface area of about 100 $m^2$/gm or greater. Commercially available alumina useful in the integrated Fischer-Tropsch process include, for example, S-400, which has a surface area of about 335 $m^2$/gm, and DD-470, which has a surface area of about 375 $m^2$/gm. S-400 ad DD-470 are alumina catalysts made and sold by Alcoa. Alumina catalysts for use in the integrated Fischer-Tropsch process generally contain at least about 90 wt % $Al_2O_3$, oxides of silicon and iron present in amounts of less than about 0.1 wt %, and oxides of sodium present in an amount of less than about 1 wt %. The alumina catalysts are generally supplied as substantially spherical particles having diameter from about ⅛ to about ¼ inch.

In another embodiment of the invention, molecular sieve or zeolitic molecular sieve forms of the alumina or silica-alumina catalysts may be used. For example, silico alumino phosphate ("SAPO") molecular sieves may be used in beds 22. SAPO molecular sieves contain a 3-dimensional microporous crystal structure having 8, 10, or 12 membered ring structures. The ring structures can have an average pore size ranging from between about 3.5 angstroms to about 15 angstroms. Other silca-containing zeolitic molecular sieve catalysts, such as ZSM-5, may be used in bed 22.

In an alternative embodiment, all or part of the HFTL may also be dehydrated. In such cases, the operating pressure of the accumulator, and thus the packed beds, should be adjusted to vaporize the HFTL stream.

The advantage of dehydration as a part of the integrated Fischer-Tropsch process is improvement of yield of useful products. It is known by those skilled in the art that oxygenates in the hydrocracking feed reduce hydrocracking catalyst life and therefore, necessitate higher hydrocracking temperatures to achieve the required low temperature properties of a specific boiling range and to maintain conversion per pass. Higher hydrocracking temperatures lead to lower product yields. Moreover, bypassing the Fischer-Tropsch product in the middle distillate range directly to product blending introduces alcohols into the final product. Alcohols are known to have poor low temperature properties, such as freeze point and pour point. Hydrocracking conditions must be intensified to compensate for the impact of the alcohols. Similarly, if the product being bypassed is hydrotreated, it is well known that paraffins generated in hydrotreatment have higher freeze point and yet again cause deterioration in the low temperature properties of the blended product. The inventive integrated Fisher-Tropsch process disposes of the alcohols by converting them into olefins which have beneficial low temperature properties.

The dehydrated product is recovered through line 24 into condenser 25, where it is condensed. The condensed product will contain aqueous and organic phases which may be separated in an accumulator 26. Both the organic and aqueous phases are essentially free of alcohols, the alcohols having been essentially completely dehydrated. The organic phase primarily contains paraffins with some olefins, the olefins arising from dehydration of the alcohols as well as from the Fischer-Tropsch product.

Figure 3:
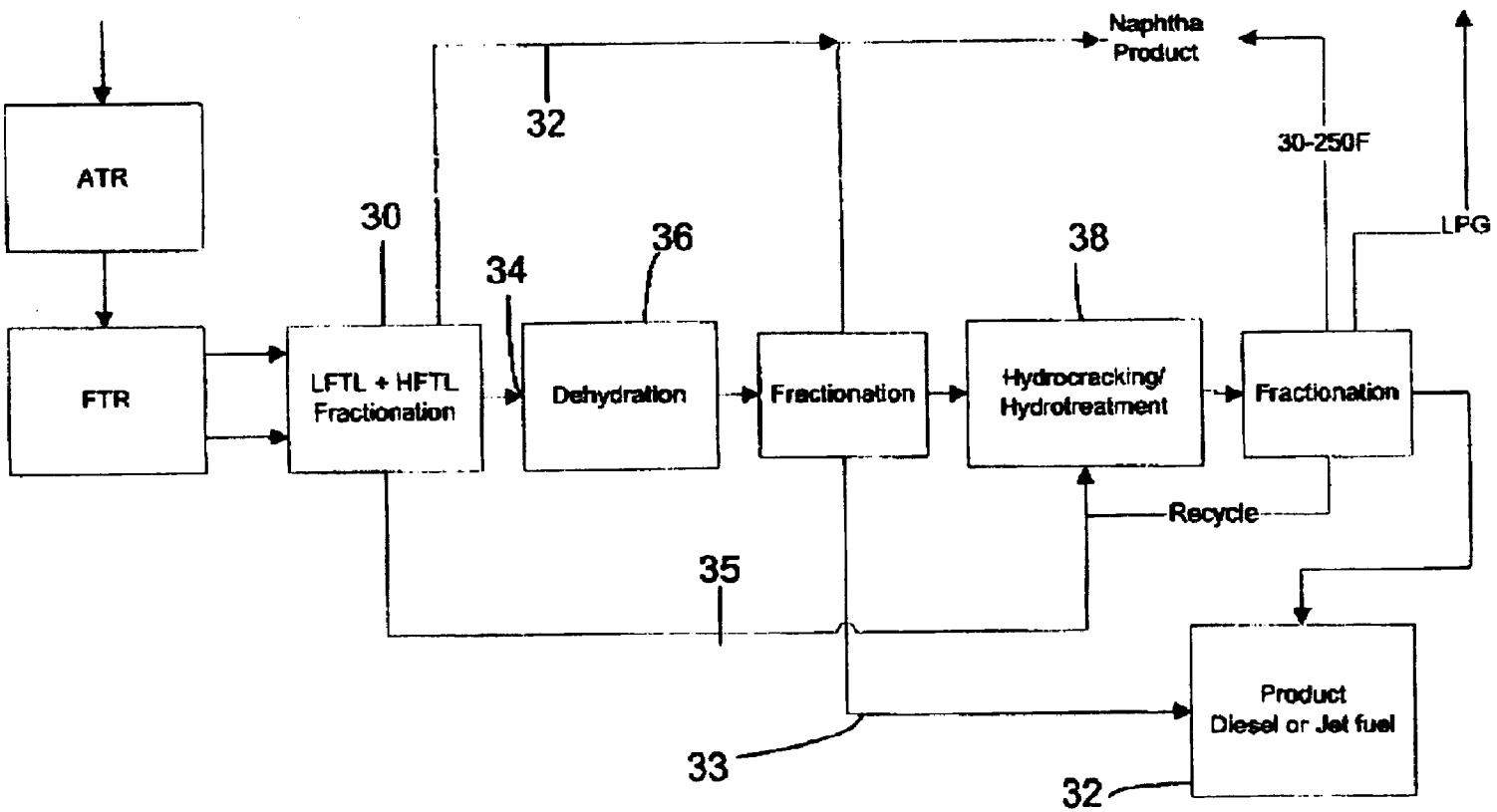
FIG. 3 is a schematic of another embodiment of the hydroprocessing unit of the integrated Fischer-Tropsch process.

FIG. 3 illustrates an alternative embodiment of the integrated Fischer-Tropsch process. Light and heavy Fischer-Tropsch liquids are combined and fractionated in a distillation column 30. The nominal 30°–600° F. product is removed as one or more side-streams, including a nominal 30°–250° F. fraction through line 32, a nominal 250°–500° F. fraction though line 34, and a nominal 500° F.+ fraction through line 35. Only the 250°–500° F. fraction is routed to the dehydration unit 36. The 250°–500° F. fraction is sent directly to a product blending area 37 after being dehydrated in dehydration unit 36.

Figure 4:
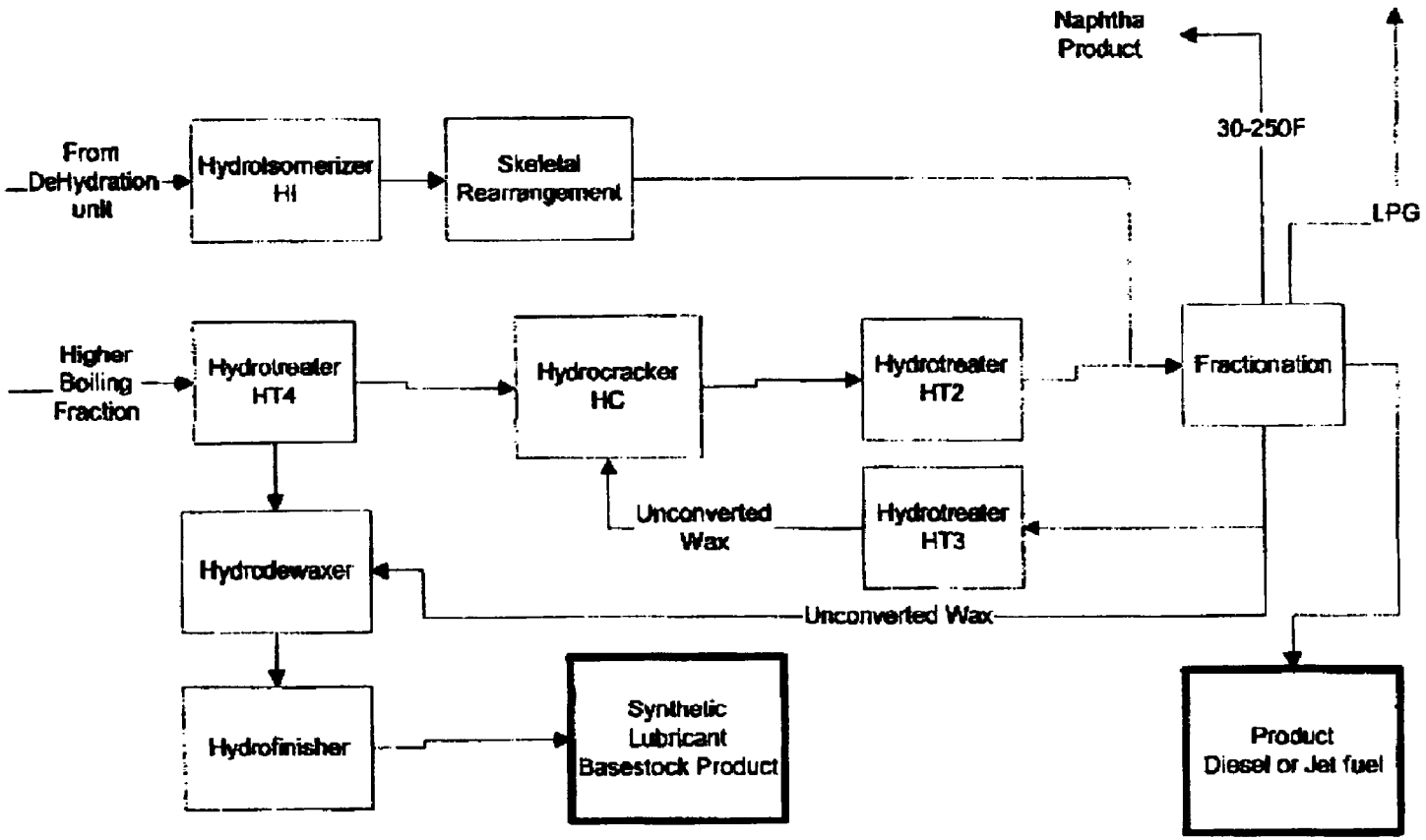
FIG. 4 is a schematic illustrating a hydrocracker/hydroisomerizer unit.

FIGS. 1 and 3 both depict a higher boiling fraction bypassing the dehydration unit and being routed to hydrocracking/hydrotreating units 10 and 38, respectively. FIGS. 1 and 3 also depict the dehydrated product mixture of paraffins and olefins as also being routed to the hydrocracking/hydrotreating units, which is appropriate where a fully hydrotreated product is desired. However, the dehydrated product mixture may alternatively be separately hydroisomerized or may receive no further hydroprocessing. FIG. 4 depicts such a hydrocracker/hydroisomerizer arrangement. However, any of a number of alternative post-dehydration and higher boiling range fraction treatment schemes may be employed within the integrated Fischer-Tropsch process depending upon the desired slate of products. For example, referring to FIG. 4, alternative treatment schemes include:

a) Hydroisomerization of the dehydrated product; hydrocracking of the higher boiling fraction followed by hydrotreatment.
b) No post-dehydration treatment of the dehydrated product; hydrocracking of the higher boiling fraction
c) No post-dehydration treatment of the dehydrated product; hydrocracking of the higher boiling fraction followed by hydrotreatment.
d) Hydroisomerization of the dehydrated product; no hydroprocessing of the higher boiling range fraction; reblending of the dehydrated—hydroisomerized product with the higher boiling range fraction followed by fractionation; hydrocracking of the bottoms stream of the fractionation.
e) Hydroisomerization of the dehydrated product; hydrocracking of the higher boiling fraction.
f) No post-dehydration treatment of the dehydrated product; hydrotreatment followed by hydrocracking of the higher boiling range fraction.
(g) Skeletal rearrangement of dehydrated product in the absence of hydrogen to preserve the olefin content; hydrocracking of higher boiling fraction.
(h) No post-dehydration treatment of the dehydrated product; hydrotreatment of the higher boiling fraction.
(i) No post-dehydration treatment of the dehydrated product; hydrotreatment, hydrocracking and hydrofinishing of the higher boiling fraction.
(j) No post-dehydration treatment of the dehydrated product; hydrotreatment and hydrocracking of the higher boiling fraction; hydrodewaxing of the unconverted hydrocracker bottoms and hydrofinishing of lubricant basestock
(k) No post-dehydration treatment of the dehydrated product; hydrocracking of the higher boiling fraction; hydrotreatment of the unconverted wax.

These alternative treatment schemes are only some of the variations encompassed by and useful in the integrated Fischer-Tropsch process. Thus, the list above is intended to merely illustrate, and not limit, a portion of the integrated Fischer-Tropsch process. Possible process conditions and parameters for hydroisomerizing, hydrotreating and hydrocracking the relevant hydrocarbon streams are well known in the art. One example of hydroprocessing conditions and parameters is described in Australian Patent No AU-B-44676/93, the disclosure of which is incorporated herein by reference. A large number of alternative hydroprocessing conditions and parameters are also known in the art and may be useful in connection with the integrated Fischer-Tropsch process described herein. Therefore, incorporation of the above-referenced Australian patent is not intended to limit the inventive process.

The processing schemes listed above may be useful in fulfilling various product slate demands and in preparing a number of products. Schemes (a), (b), (c), (d), (e), (f), (g), and (k) are useful for producing ultra-clean synthetic middle distillate fuels. Schemes (c) and (h) are useful for producing high grade synthetic waxes. Schemes (i) and (j) are useful for making high quality synthetic lubricants. In addition, schemes (b), (c), (f), (h), (i), (j), and (k) are useful for making olefin/paraffin mixtures as dehydrated product which can be used as feedstocks for (I) linear olefins, (II) linear and branched alcohols, (III) feedstock for linear alkyl benzenes production, (IV) high an low octane gasoline blendstocks, and (V) single product middle distillate fuel feedstocks.

In one useful embodiment of the integrated Fischer Tropsch process, the syncrude is manufactured from autothermal reformation of methane containing gas, generally in the form of coal or natural gas, in the presence of air. The resulting syncrude is comprised primarily of paraffins, olefins and oxygenates in the form of alcohols, with the alcohols being primarily primary alcohols. The dehydration component of the integrated Fischer Tropsch process selectively treats the alcohols and converts the alcohol component into the corresponding olefins. Thus, the product in this embodiment of the integrated Fischer Tropsch process is a mixture of paraffins and olefins with no alcohol content. Thus, the resulting Fischer Tropsch product comprises only two moieties, paraffins and olefins, which are rheologically, toxicologically, conductively, oxidatively and reactively similar. This Fischer Tropsch product may then be fractionated to obtain carbon number cuts for use in a wide variety of applications where no oxygenate, or alcohol, content is highly desirable. For example, a $C_{10}$–$C_{13}$ fraction may be used as feedstock to produce detergent grade linear alkyl benzenes and synthetic lubricants, a $C_{14}$–$C_{17}$ fraction may be used as feedstock for production of drilling fluids, chloroparaffins, specialty alkylates and synthetic lubricants, a $C_{15}$–$C_{19}$ fraction may be used as feedstock for specialty additives and transformer oil additives, and a $C_4$–$C_9$ fraction may be used as feedstock for naphtha formulation or as a feed to oligomerization.

EXAMPLE 1

A pilot installation consisting of two distillation columns was used to produce $C_{6\text{-}10}$ naphtha, $C_{10\text{-}13}$ light kerosene, and $C_{13\text{-}20+}$ drilling fluid feedstock streams. The columns were fed approximately 3400 g/hr of liquid Fischer-Tropsch oil. Fischer-Tropsch oil had approximately the following composition:

| Carbon # | % by wt. |
|---|---|
| 4 | <0.1 |
| 5 | 0.01 |
| 6 | 0.3 |
| 7 | 1.0 |
| 8 | 2.9 |
| 9 | 5.9 |
| 10 | 8.1 |
| 11 | 9.2 |
| 12 | 9.5 |
| 13 | 9.2 |
| 14 | 8.4 |
| 15 | 7.9 |
| 16 | 7.1 |
| 17 | 6.2 |
| 18 | 5.4 |
| 19 | 4.6 |
| 20 | 3.7 |
| 21 | 3.0 |
| 22 | 2.3 |
| 23 | 1.7 |
| 24 | 1.2 |
| 25+ | 2.6 |
| Total | 100.00 |

Fischer-Tropsch oil was fed into the first column and $C_{13}$ and lighter materials were distilled overhead. The column conditions were: 10 psig pressure, 480° F. feed preheat temperature, 407° F. overhead temperature, 582° F. bottoms temperature. The first column had approximately 98 inches of Sulzer Mellapack 750Y packing. The overheads of the first column was fed into the second column operating at 12 psig pressure, 370° F. overhead temperature and 437° F. bottoms temperature. The second column is packed with 28 inches of Sulzer EX packing. The bottoms of the second column constituted the product $C_{10\text{-}13}$ light kerosene stream. The bottoms of the first column constituted $C_{13\text{-}20+}$ heavy diesel and drilling fluid feedstock. The compositions of $C_{10\text{-}13}$ light kerosene stream (Feed A) and $C_{13\text{-}20+}$ (Feed B) are shown in Tables 1 and 2, respectively.

TABLE 1

| Total n-paraffins, isoparaffins, olefins and alcohols | Mass % |
|---|---|
| C7– | 0.02 |
| C8 | 0.25 |
| C9 | 1.29 |
| C10 | 9.83 |
| C11 | 33.51 |
| C12 | 43.04 |
| C13 | 11.47 |
| C14 | 0.49 |
| TOTAL C15+ | 0.10 |
| | 100.00 |

TABLE 2

| Total n-paraffins, isoparaffins, olefins and alcohols | Mass % |
|---|---|
| C11–: | 0.97 |
| C12: | 1.77 |
| C13: | 11.43 |
| C14: | 13.68 |
| C15: | 12.35 |
| C16: | 10.96 |
| C17: | 9.06 |
| C18: | 7.84 |
| C19: | 6.79 |
| C20: | 7.04 |
| C21: | 5.66 |
| C22: | 4.63 |
| C23+: | 7.83 |
| | 100.00 |

EXAMPLE 2

30 cc/hr of a Feed A from Example 1 was fed via a syringe pump and mixed with 20 cc/min of nitrogen. The gas/liquid mixture was introduced upflow into a vessel packed with stainless steel mesh saddles, where the liquid was vaporized and superheated to reaction temperature of 560° F. The vaporized feed was fed upflow into a reactor packed with ⅛ Alcoa S-400 alumina catalyst and suspended in a heated sandbath. The sandbath was maintained at the reaction temperature and ebulated by air. Reactor LHSV was maintained at about 0.26 $hr^{-1}$. The reactor outlet was condensed and Product A and water by-product was collected in a product accumulator. System pressure was maintained by controlling the product accumulator overhead pressure at 50 psig. Water layer was drained and product analyzed in a HP 5890 Series II GC with a 60 m RTX1 capillary column with a 0.32 mm bore and 3-micron film thickness. The compositions of the feed and Product A are reported in Table 3. The product was also analyzed on a $^1H$ NMR 300 MHz JOEL analyzer, confirming complete absence of alcohols.

EXAMPLE 3

15 cc/hr of Feed A from Example 1 was processed in a benchscale process described in Example 2. The feed was vaporized and superheated to 650° F. Reactor LHSV was approximately 0.13 $hr^{-1}$. Composition of Product B from this example is reported in Table 3. $^1H$ NMR analysis confirmed absence of alcohols in the product.

TABLE 3

| | | Feed | Product A | Product B |
|---|---|---|---|---|
| TOTAL | | | | |
| N-PARAFFIN | mass % | 80.64 | 80.23 | 79.90 |
| ALPHA OLEFIN | mass % | 4.43 | 8.20 | 7.96 |
| INTERNAL OLEFIN | mass % | 3.04 | 3.37 | 3.91 |
| BRANCHED PARAFFIN | mass % | 8.21 | 8.19 | 8.22 |
| ALCOHOL | mass % | 3.68 | 0.00 | 0.00 |
| | mass % | 100.00 | 100.00 | 100.00 |

EXAMPLE 4

Feed A from Example 1 was spiked with approximately 5% of hexanol, composing Feed A' and fed at 15 cc/min into a benchscale process described in Example 3. Nitrogen feed was maintained at 10 cc/min. Composition of Product C from this example is reported in Table 4. $^1$H NMR analysis confirmed absence of alcohols in the product.

TABLE 4

| | | Feed A | Product C |
|---|---|---|---|
| TOTAL | | | |
| N-PARAFFIN | mass % | 75.12 | 75.14 |
| ALPHA OLEFIN | mass % | 4.15 | 10.75 |
| INTERNAL OLEFIN | mass % | 3.03 | 4.47 |
| BRANCHED PARAFFIN | mass % | 9.67 | 9.64 |
| ALCOHOL | mass % | 8.03 | 0.00 |
| | mass % | 100.00 | 100.00 |

EXAMPLE 5

Feed B from Example 1 was fed into a process described in Example 4. The reaction temperature was maintained at 675° F. and the outlet pressure was maintained at about 5 psig. The reaction Product D is shown in Table 5.

TABLE 5

| | | Feed B | Product D |
|---|---|---|---|
| TOTAL | | | |
| N-PARAFFIN | Mass % | 82.46 | 82.87 |
| ALPHA OLEFIN | Mass % | 2.26 | 3.48 |
| INTERNAL OLEFIN | Mass % | 2.75 | 3.68 |
| BRANCHED PARAFFIN | Mass % | 10.10 | 9.97 |
| ALCOHOL | Mass % | 2.45 | 0.00 |
| | | 100.00 | 100.00 |

What is claimed is:

1. In a Fischer-Tropsch process wherein a synthesis gas is catalytically converted into a Fischer-Tropsch reaction product mixture comprising paraffins and oxygenates and wherein the oxygenates include primary and internal alcohols, the process improvement comprising:

($a_1$) passing all or part of the Fischer-Tropsch reaction product mixture over at least one bed packed with an alumina catalyst to dehydrate substantially all of the alcohols to their corresponding olefins.

2. The process improvement of claim 1 further comprising the step of($a_0$) vaporizing all or part of the Fischer-Tropsch reaction product mixture before step ($a_1$).

3. The process improvement of claim 1 further comprising the steps of:

(b) condensing a dehydrated product;

(c) separating aqueous and organic phases of the dehydrated product.

4. The process improvement of claim 1 further comprising the step of hydroisomerizing all or part of the organic phase.

5. The process improvement of claim 1 wherein the reaction temperature of dehydration in step ($a_1$) is between about 400° and about 800° F.

6. The process improvement of claim 1 wherein the alumina is a high surface area alumina.

7. The process improvement of claim 6 wherein the alumina is selected from the group of gamna-alumina and theta-alumina.

8. The process improvement of claim 1 wherein the alumina is passivated alumina.

9. The process improvement of claim 1 wherein the reaction temperature of dehydration in step ($a_1$) is between about 500° and about 700° F.

10. The process improvement of claim 1 wherein the reaction temperature of dehydration in step ($a_1$) is between about 550° and about 675° F.

11. The process improvement of claim 1 wherein the alumina catalyst is activated alumina.

12. The process improvement of claim 1 wherein the LHSV of the packed bed is between about 0.1 $hr^{-1}$ and about 10.0 $hr^{-1}$.

13. The process improvement of claim 1 wherein the LHSV of the packed bed is between about 0.12 $hr^{-1}$ and about 2.0 $hr^{-1}$.

14. The process improvement of claim 1 wherein step ($a_1$) is operated at a pressure of from about 0 psia to about 200 psig.

15. The process improvement of claim 3 wherein the Fischer-Tropsch reaction product mixture comprises from about 0 wt % to about 95 wt % olefins.

16. The process improvement of claim 3 wherein the Fischer-Tropsch reaction product mixture comprises from about 0.5 to about 40 wt % oxygenates.

17. The process improvement of claim 16 wherein at least 90 wt % of the oxygenates are primary and internal alcohols.

18. An integrated Fischer-Tropsch process comprising the steps of:

(a) producing a synthetic crude by Fischer-Tropsch reaction of synthesis gas;

(b) fractionating the synthetic crude at least into a light Fischer-Tropsch liquid, and a heavy Fischer-Tropsch liquid; and (c) reacting at least a part of the light Fischer-Tropsch liquid over an alumina catalyst to dehydrate alcohols in the light Fischer-Tropsch liquid to corresponding alpha- and internal-olefins and forming a dehydrated product.

19. The process of claim 18 further comprising the step of:

(d) fractionating the dehydrated product into at least a naphtha, nominally 30–300° F., fraction, and at least one middle distillate fraction, nominally 250–600° F.

20. The process of claim 18 further comprising the step of (e) hydroisomerizing all or part of the middle distillate.

21. The process of claim 18 further comprising the step of:

(f) hydroprocessing all or part of the heavy Fischer-Tropsch liquid.

22. The process improvement of claim 1 wherein the synthesis gas is prepared from a gas comprising methane.

23. The process improvement of claim 22 wherein the synthesis gas is produced by autothermal reformation.

24. The process improvement of claim 23 wherein the autothermal reformation feedstock comprises 10% to 60% $N_2$.

25. The process improvement of claim 22 wherein the gas is natural gas.

26. The process improvement of claim 22 wherein the gas is coal gas.

27. The process improvement of claim 1 wherein at least 95 wt % of alcohols present in the Fischer-Tropsch reaction product are converted to olefins in step ($a_1$).

28. The process improvement of claim 1 wherein the dehydrated product from step ($a_1$) contains substantially no alcohols.

29. The process improvement of claim 1 wherein the dehydrated product from step ($a_1$) 2contains substantially no oxygenates.

30. The process of claim 18 wherein at least 95 wt % of alcohols present in the light Fischer-Tropsch liquid are converted to olefins in step (c).

31. The process of claim 18 wherein the dehydrated product from step (c) contains substantially no alcohols.

32. The process of claim 18 wherein the dehydrated product from step (c) contains substantially no oxygenates.

33. The process of claim 18 wherein the synthesis gas is prepared from a gas comprising methane.

34. The process of claim 33 wherein the synthesis gas is produced by autothermal reformation.

35. The process of claim 34 wherein the autothermal reformation syngas product comprises 10% to 60% $N_2$.

36. The process of claim 1 wherein step ($a_1$) is conducted over a moving bed of alumina catalyst and further comprising continuous catalyst regeneration.

37. The process of claim 36 wherein the moving bed is selected from the group of ebullating beds, slurry bed and a fluidized bed.

38. The process of claim 1 wherein the catalyst is selected from the group of silica-alumina, silico-alumino phosphate, and molecular sieves.

39. The process of claim 38 wherein the molecular sieve is a zeolite.

40. The process of claim 18 wherein step (c) is conducted over a moving bed of alumina catalyst and further comprising continuous catalyst regeneration.

41. The process of claim 40 wherein the moving bed is selected from the group of ebullating beds, slurry bed and a fluidized bed.

* * * * *